US005311678A

United States Patent [19]

Spademan

[11] Patent Number: 5,311,678

[45] Date of Patent: May 17, 1994

[54] SHOE SHOCK ABSORPTION SYSTEM

[76] Inventor: Richard G. Spademan, 2600 Capitol Ave., Sacramento, Calif. 95816

[21] Appl. No.: 21,631

[22] Filed: Feb. 19, 1993

Related U.S. Application Data

[63] Continuation of Ser. No. 500,812, Mar. 28, 1990, abandoned, which is a continuation-in-part of Ser. No. 11,409, Feb. 4, 1987, Pat. No. 4,924,605, which is a continuation-in-part of Ser. No. 736,666, May 22, 1985, abandoned, which is a continuation-in-part of Ser. No. 688,464, Jan. 3, 1985, abandoned, which is a continuation-in-part of Ser. No. 623,449, May 14, 1984, abandoned, which is a continuation-in-part of Ser. No. 538,079, Jan. 30, 1984, abandoned.

[51] Int. Cl.[5] ..... A43B 5/00; A43B 7/14

[52] U.S. Cl. ..... 36/114; 36/119; 36/88; 36/28

[58] Field of Search ..... 36/28, 58.5, 114, 50, 36/91, 88, 89; 128/610, 611, 613

[56] References Cited

U.S. PATENT DOCUMENTS

| | | | |
|---|---|---|---|
| 2,850,813 | 9/1958 | Willamee | 128/611 |
| 3,566,486 | 3/1971 | Conway | 36/114 |
| 3,828,448 | 8/1974 | Leonildo . | |
| 4,236,328 | 12/1980 | Friedlander . | |
| 4,342,161 | 8/1982 | Schmohl . | |
| 4,393,876 | 7/1983 | Dieterich . | |
| 4,446,634 | 5/1984 | Johnson et al. . | |
| 4,447,968 | 5/1984 | Spademan . | |
| 4,546,555 | 10/1985 | Spademan . | |
| 4,592,154 | 6/1986 | Oatman | 36/114 |
| 4,794,706 | 1/1989 | Puckhaber et al. | 36/91 |
| 4,811,502 | 3/1989 | Barret | 128/611 |
| 4,901,451 | 2/1990 | Cumin | 36/50 |
| 4,924,605 | 5/1990 | Spademan | 36/114 |

FOREIGN PATENT DOCUMENTS

| | | | |
|---|---|---|---|
| 0329392 | 8/1989 | European Pat. Off. | 36/114 |

*Primary Examiner*—Steven N. Meyers

*Attorney, Agent, or Firm*—Townsend and Townsend Khourie and Crew

[57] ABSTRACT

A shoe (1, 30, 6) is disclosed in which there is a provided sensing means (16, 45, 66) for transmitting the force of shoe-support surface impact from the bottom of the lower sole (2, 31, 61) to the upper shell (3, 32, 62) and foot as the foot is moved toward the bottom of the lower sole. Means are provided (17, 50, 65, 67) for varying the amount of force transmitted and length of time that the force is transmitted from the lower sole (2, 31, 61) to the upper shell (3, 32, 62) and foot.

11 Claims, 3 Drawing Sheets

SHOE SHOCK ABSORPTION SYSTEM

RELATED APPLICATIONS

The present application is a continuation of continuation-in-part application U.S. patent application Ser. No. 07/500,812 filed Mar. 28, 1990, now abandoned which was a continuation-in-part of U.S. patent application Ser. No. 07/011,409 filed Feb. 4, 1987, now U.S. Pat. No. 4,924,605 which was a continuation-in-part of U.S. patent application Ser. No. 06/736,666 filed May 22, 1985 now abandoned, which was a continuation-in-part of U.S. patent application Ser. No. 06/688,464 filed Jan. 3, 1985, now abandoned, which was continuation-in-part of U.S. patent application Ser. No. 06/623,449 filed May 14, 1984, now abandoned, which was a continuation-in-part of U.S. patent application Ser. No. 06/538,079 filed Jan. 30, 1984, now abandoned.

BACKGROUND OF THE INVENTION

Shoes such as walking, running, tennis, basketball, aerobic and soccer shoes must distribute the force of shoe-support surface impact and fit tightly on the user's foot. The force distribution and tightness of the fit needs to be greatest when the largest forces are being applied between the shoe and the support surface. It has been typical to rely on the sole to distribute the force and to tighten the shoe as much as possible, and physically bearable, to prevent or at least minimize relative movement of the foot in the shoe at times when maximum forces are transmitted between the support surface and the shoe. As a practical matter, the shock absorption is usually inadequate and such a fit is excessively tight during most times and quite frequently is uncomfortable, can lead to numbness and, in extreme cases, can even result in injuries. Thus, a compromise is frequently reached in the design and composition of the sole and by tightening the shoe on the foot more than is necessary for the small forces that are applied and less than is desired to prevent relative movement of the foot in the shoe when large forces are applied. Consequently, the shock absorbtion characteristics and the fit of such shoes is almost always other than what it should be.

Up to now, little or no consideration has been given to the shock absorbtion characteristics and the relative tightness of street and sport shoes, particularly lightweight, highly mobile shoes such as running, tennis, track and field and contact sport shoes. The lightness of such shoes and the lack of an adequate analysis of the interaction between the shoe, the user's foot and the support surface has led to the practice of relying on the elastomer sole to distribute the impact force and simply tightening the shoe to suit the user's taste, feel or preference. In some instances, the shoe might be too loose and not infrequently, slipped significantly relative to the foot in a particularly strenuous maneuver such as a sudden change in direction when turning. In addition, the impact force to the foot has not been adequately distributed.

Upon closer analysis, however, it becomes apparent that there are distinct phases in the use of a shoe, particularly a sport shoe, when forces applied by the foot to the shoe momentarily greatly exceed the normally encountered forces. During heel strike, for example, there are forces generated by both the player's weight which tend to concentrate the impact force in the area of the heel and there is the deceleration of the foot which tends to move the foot in a forward direction relative to the shoe. Such movements may be relatively small, say in the order of no more than a few millimeters but they are present and, typically, they are repeated thousands of times during play. This force distribution and foot slippage can lead to discomfort, skin irritation from rubbing between the foot and the shoe, injury and energy losses, which though small, are highly undesirable, particularly in competitive sports.

SUMMARY OF THE INVENTION

The present invention greatly reduces or eliminates relative movement between the foot and the shoe while improving the shock absorption characteristics by temporarily increasing the tightness of the fit of the shoe on the foot as a function of weighting the shoe during foot strike and prolonging the tightness throughout shoe-support surface contact. At the same time, the tightness of the fit can be reduced when the foot is in its unweighted condition when minimum forces are exerted to prevent discomfort or possible injury from an overtightening of the shoe for excessive lengths of time. In particular, the present invention increases the tightness of the fit when the foot weights the sole or a dynamically movable footbed upon foot strike moving the foot toward the bottom of the sole resulting in a tightening of the shoe. The invention also provides means for prolonging this tightened condition and dispersing the energy of foot strike impact by the movement of the shoe sole or the footbed increasing distribution of impact force to the upper foot.

Broadly speaking, therefore, the present invention provides a shoe, which may be a street shoe or a sport shoe, forming a comfortable close or snug fit on the foot when the foot is in a generally unweighted condition. The tightness of the fit is increased and thus the distribution of the impact force, when the foot is placed in a weighted condition and this tightness is maintained for a predetermined period of time. This is accomplished with means for sensing a relative weighting or compression of the sole or the downward movement of a dynamically movable footbed and means operatively coupled with the sensing means and the shoe for increasing and maintaining the tightness of the fit of the shoe for a predetermined period of time on the foot in response to a relative loading of the lower extremity which moves the foot toward the bottom of the sole of the shoe.

One embodiment of the invention provides a strap assembly located on each side of the foot in the shoe. One end of each strap is attached to the inside of the shoe shell in the area of the foot instep. Each strap then passes in a downward and rearward direction and is attached in the area of the rear of the heel of the foot to the side of a semirigid dynamically movable footbed. The footbed extends from the toe end of the shoe to the heel end and is separated from the shoe sole in the heel area by a variable size elastomer pad having specified loading and elastic rebound characteristics, a low compression set and a very slow recovery from compression such as a flexible polyurethane material. Downward movement of the footbed in the heel region toward the bottom of the sole during weighting pulls the straps in a downward and rearward direction tightening the straps over the foot instep, as a function of the extent to which the foot heel and midfoot have moved toward the bottom of the sole. The period of time that the shoe maintains the tightened condition depends upon the recovery period of the elastomer pad located between and secured to the dynamically movable footbed and the upper surface of the sole of the shoe.

In use, the shoe is closed and tightened to a comfortable close snug fit by a conventional lacing arrangement. During foot strike, the dynamically movable footbed moves in a downward direction pulling the straps in a downward and rearward direction. The distance that the footbed moves in the heel area is greater that the distance the footbed moves in the midfoot area. Thus, there is tightening of the straps and shoe over the instep. Since the elastomer pad recovers at a slower rate than the rate of unweighting of the foot heel, the shoe remains tight on the foot for an extended period of time.

In a shoe, therefore, the tightness of the fit is temporarily increased during foot strike when the foot is weighted and moves toward the bottom of the sole and the tightness is maintained for a predetermined period of time. Consequently, during those moments when large forces are transmitted from the foot to the ground via the shoe, the shoe fits the tightest, and distributes the impact force to the instep of the foot thereby reducing movements of the foot in the shoe.

To summarize, the present invention provides a dynamic fitting system for shoes which allows a reduced tightness snug unweighted condition for the foot when the tightness of the fit is at a minimum and which increases and maintains the tightness for a predetermined period of time and distributes the shock force in response to movement of the foot toward the bottom of the sole. This greatly enhances the utility of a shoe in that it is tightest on the foot when the foot is moved in a downward direction toward the bottom of the sole which typically is the condition during which maximum forces are transmitted between the foot and the shoe. Due to the prolonged tightness of the fit, relative movements between the foot and the shoe are minimized. Yet, the discomfort and possibility of injury which would accompany the use of a shoe tightened to take into account maximum forces, which are encountered for only fractions of a second, are eliminated, because when the foot is in its relative unweighted condition, or in a condition which deviates therefrom by only a minor amount, the fit of the shoe can be such as to cause no discomfort whatsoever.

DESCRIPTION OF THE PREFERRED EMBODIMENTS

Figure 1:
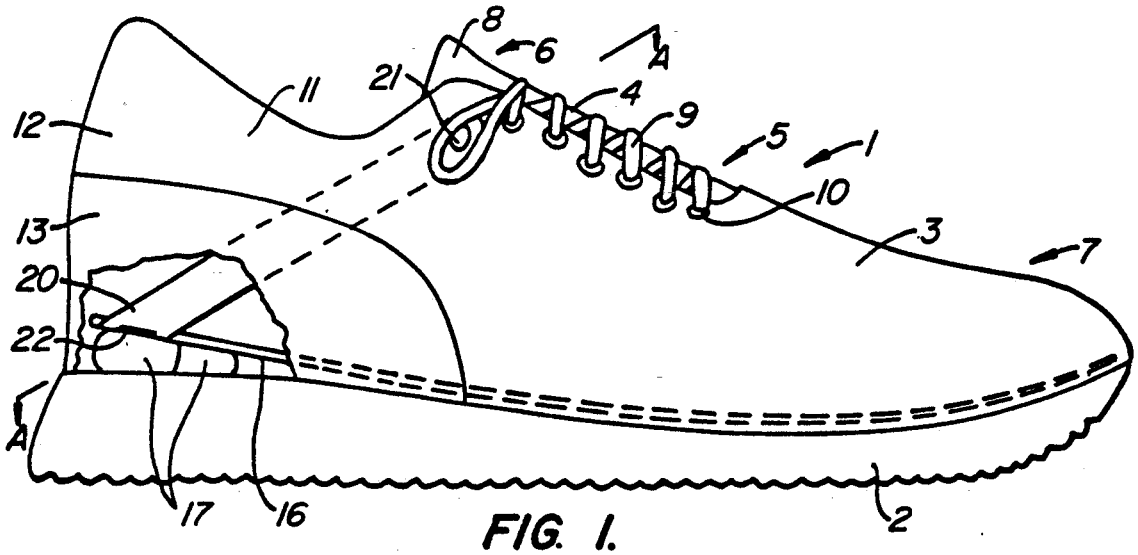
FIG. 1 is a side elevational view of a shoe provided with a shock absorption system in an unweighted condition constructed in accordance with the present invention.
Figure 2:
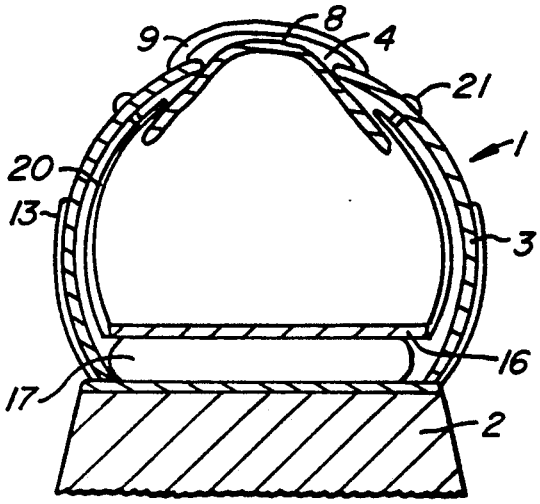
FIG. 2 is a vertical section through the shoe of FIG. 1, taken along lines A—A of FIG. 1.
Figure 4:
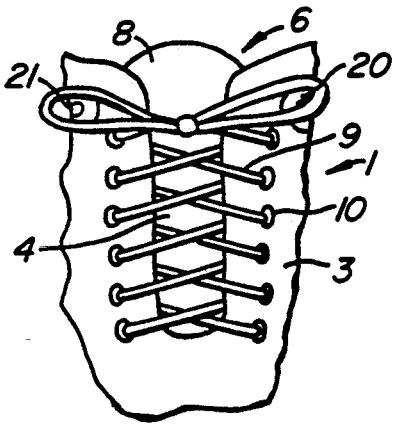
FIG. 4 is a partial top view of the shoe of FIG. 1.

Referring to FIGS. 1-5, a shoe 1 has a lower sole 2 and an upper shell 3 secured to the lower sole and defining the inside of the shoe within which the user places his or her foot. The upper shell of the shoe includes a conventional, typically V-shaped cut out 4 above the forefoot and midfoot 5 and extending generally from about the instep 6 towards the front or toe end 7 of the shoe. A tongue 8 underlies the cutout and is secured to the upper in the area of the toe end of the shoe. The V-shaped cut out may be closed by a lace 9 passing through eyelets 10 arranged in the conventional manner. The upper is further defined by a cuff 11 which is usually located below the user's ankle joint. The upper shell 3 includes a heel end 12 which surrounds and engages the user's heel and which includes a semirigid heel counter 13.

Located within the shoe is a dynamically movable footbed 16 which extends forwardly from the heel end of the shoe to the toe area of the user's foot. The semirigid footbed 16 is separated from the shoe sole in the heel area by a variable size low compression set, very slow recovery segmented elastomer pad 17 with specified loading and elastic rebound characteristics which is secured to the footbed and sole. A less rigid footbed may be used if the pad extends to the midfoot. One end of a tightening mechanism strap 20 located on each side of the shoe is attached to the inside of the shoe shell, in the area of the foot instep by a rivet 21 or the like. Each strap 20 which may be padded and located between a liner and the shoe shell passes in a downward and rearward direction and is attached to the side of the footbed in the area of the heel by a staple 22 or the like.

Figure 3:
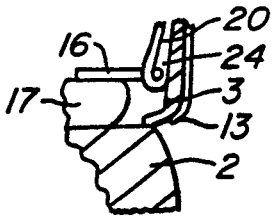
FIG. 3 is a partial vertical section through the shoe of FIG. 1 taken along lines A—A of FIG. 1 constructed in accordance with an alternative arrangement of the tightening mechanism strap.
Figure 5:
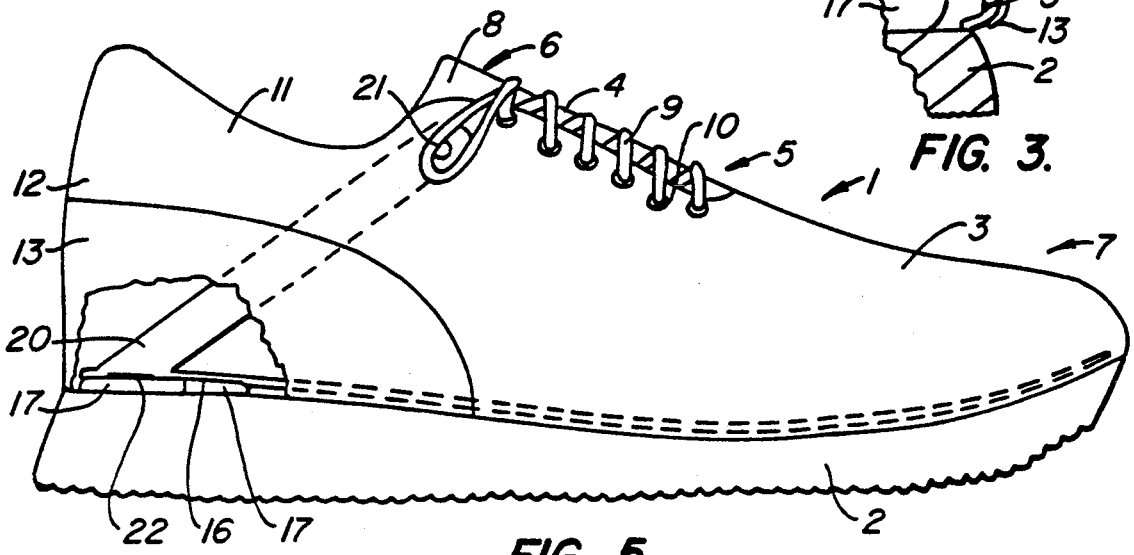
FIG. 5 is a vertical section through the shoe of FIG. 1, taken along lines A—A of FIG. 1 with the shock absorption system in a weighted condition.
Figure 6:
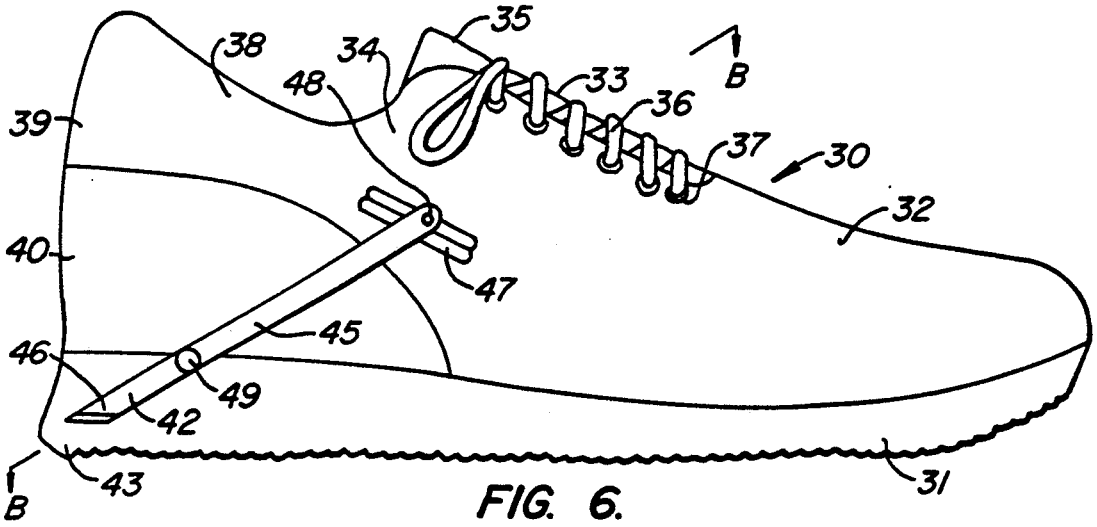
FIG. 6 is a side elevational view of a shoe including a shock absorption system in an unweighted condition constructed in accordance with another embodiment of the present invention.
Figure 7:
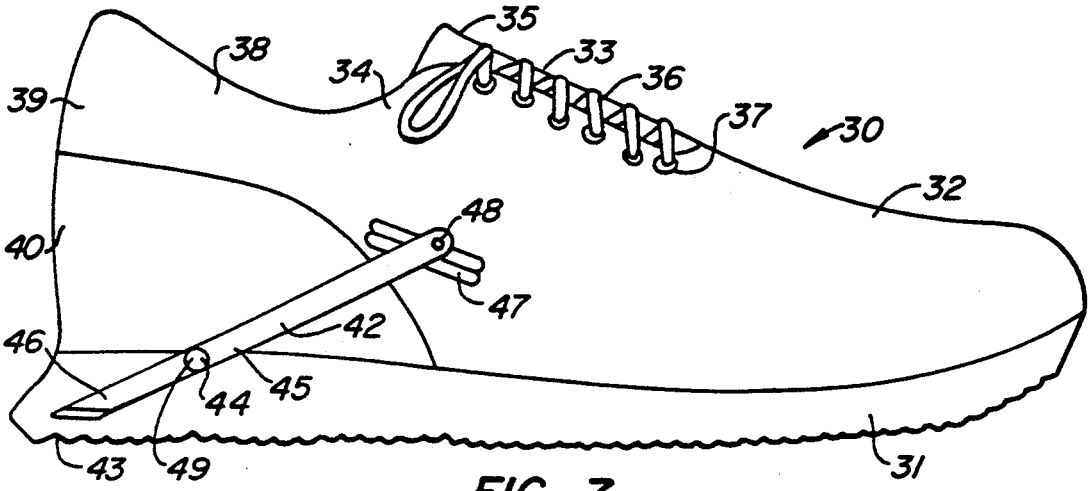
FIG. 7 is a side elevation view of the shoe of FIG. 6 in a weighted condition.
Figure 8:
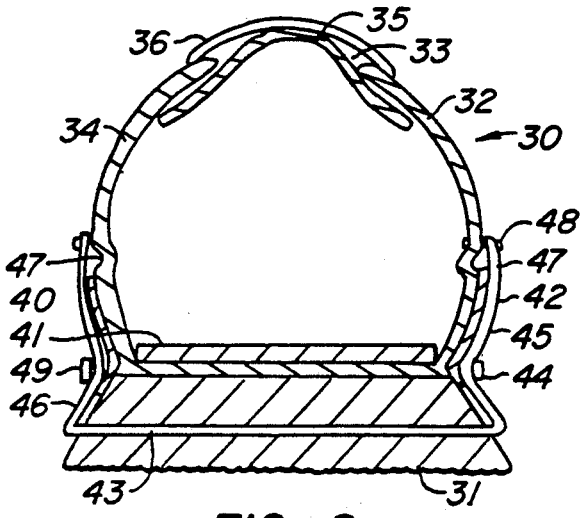
FIG. 8 is a vertical section through the shoe of FIG. 6, taken along lines B—B of FIG. 6.
Figure 9:
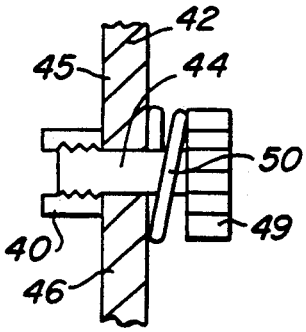
FIG. 9 is an enlarged vertical section through the recovery delaying friction mechanism of the shoe of FIG. 6.
Figure 10:
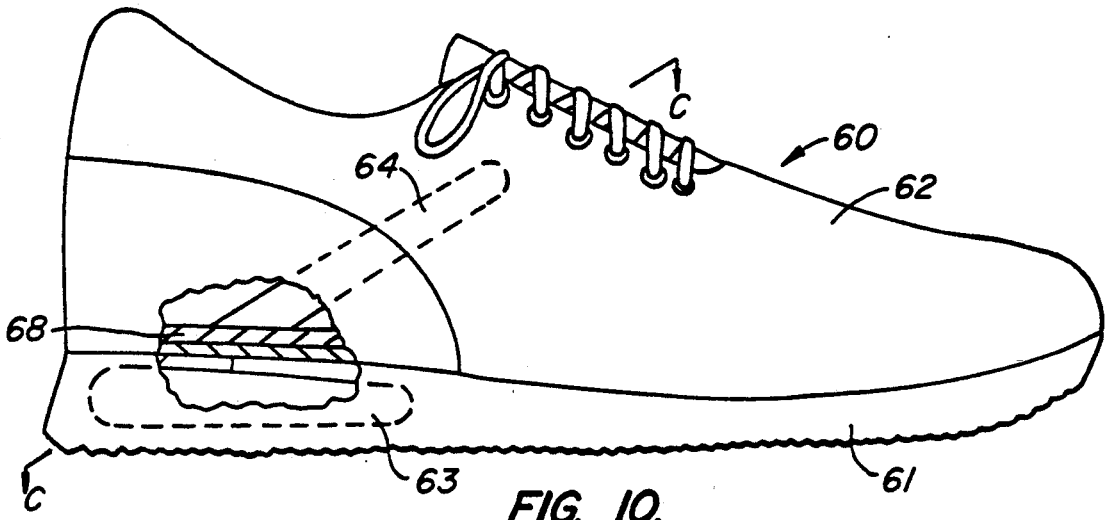
FIG. 10 is a side elevational view of a shoe including a shock absorption system constructed in accordance with still another embodiment of the present invention.
Figure 11:
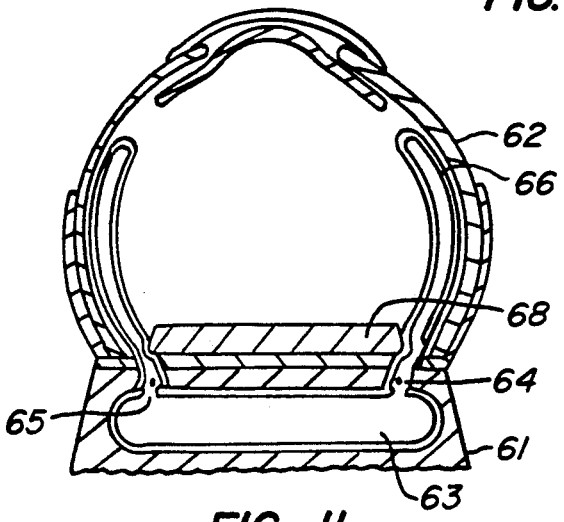
FIG. 11 is a vertical section through the shoe of FIG. 10, taken along lines C—C of FIG. 10.
Figure 12:
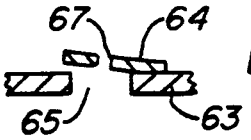
FIG. 12 is an enlarged vertical section through the recovery delaying valve mechanism of the shoe of FIG. 10.
Figure 13:
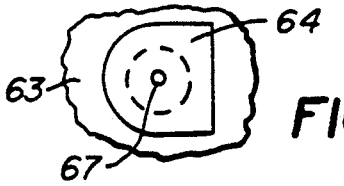
FIG. 13 is an enlarged plan view of the recovery delaying valve mechanism of the shoe of FIG. 10.

An alternative arrangement of the tightening mechanism strap 20 directs the strap 20 through a slot 23 in footbed 16. The strap 20, as shown in FIG. 3, is attached to the inside of the upper shell 3 in the area of the heel by a rivet 24 or the like.

In use, the shoe is closed and tightened to a close snug fit by the lace arrangement. During foot strike, the sensing means footbed 16 moves in a downward direction moving the foot heel toward the bottom of the lower sole 2. The tightening means strap 20 and thus the shoe 1 is temporarily tightened over the instep distributing the force to the instep and reducing movements of the foot in the shoe. This tightness is maintained for a predetermined period of time due to the very slow recovery to the unweighted condition of the segmented elastomer pad 17 secured to the footbed and sole following unweighting of the sole. The amount of force and length of time that the force is transmitted from the lower sole 2 to the upper shell 3 and foot may be varied by varying the size of the segmented elastomer pad 17.

Directing the strap 20 through the slot 23 in the footbed and attaching the strap to the inside of the upper shell 3 provides a mechanical advantage, further increasing the tightness of the strap 20 and shoe on the foot as the footbed 16 is lowered toward the bottom of the lower sole 2.

Referring to FIGS. 6–9 in another embodiment of the present invention, a shoe 30 has a lower sole 31 constructed of a resilient material such as a compressible elastomer and an upper shell 32 constructed of flexible material such as leather or nylon secured to the sole. The upper shell includes a V-shaped cut out 33 above the forefoot and midfoot in the vamp 34. A tongue 35 underlies the cut out and is secured in the vicinity of the toe end of the shoe. The V-shaped cut out can be closed by the lace 36 passing through eyelets 37 arranged in the conventional manner or by Velcro ® straps known per se. The upper is further defined by a cuff 38 which is usually located below the user's ankle joint but may be higher in basketball shoes or the like. The upper shell 32 terminates in a heel end 39 which surrounds and engages the user's heel and which includes a semirigid heel counter 40. A footbed 41 is located within the shoe. A bar 42 is located on each side of the outside of the shoe 30 and extends from the vamp 34 to the lower sole 31 and includes a cross member 43 embedded in the compressible elastomer or the like sole 31. The bar is pivoted from each side of the shoe 30 by an adjustable pivot bolt 44 secured on each side of the shoe in the semirigid heel counter 40. The bar 42 includes a bar upper segment 45 and a bar lower segment 46. The upper ends of the bar upper segment 45 are secured above a pleated section 47 in the vamp 34 of the upper shell 32 by a rivet 48 or the like. The adjustable pivot bolt 44 includes a head 49. Located between the bolt head 49 and the bar 42 is a partially compressed coil spring 50. A coned disk spring may be used.

In use, the shoe is closed and tightened to a close snug fit by the lace arrangement. During foot strike, the lower sole 31 is compressed pivoting the sensing means bar lower segment 46 in an upward direction and the tightening means bar upper segment 45 in a downward direction. This movement pulls the pleated section 47 of the upper shell 32 in a downward and rearward direction tightening the vamp on the foot distributing the force to the midfoot and forefoot and reducing movements of the foot in the shoe. This tightness is maintained for a predetermined period of time due to the very slow recovery to the unweighted position of the bar 42 as a result the friction between the coil spring 50 and the bar 42 following unweighting of the sole. The amount of force and length of time that the force is transmitted from the lower sole 31 to the upper shell 32 and foot may be varied by varying the amount of compression of the compression spring 50 by means of the adjustable pivot bolt 44.

Referring to FIGS. 10–13 in still another embodiment, a shoe 60 has a resilient elastomer or the like compressible lower sole 61 and an upper shell 62. The upper shell 62 of the shoe 60 includes a conventional closure arrangement. A lower bladder 63 is located within the compressible lower sole 61 and has flap valves 64 that open in an upward direction, fluid passages 65 communicating with smaller upper bladders 66 located above the lower sole 61 within the shoe upper shell 62 in the area of the instep of the foot. The fluid distensible bladders contain gas such as Freon ® or an oil or other flow material. The flap valves 64 located between lower bladder 63 and upper bladders 66 include passages 67 which are smaller than passages 65 to slow the rate of return of the fluid from the upper bladders 66 to the lower bladder 63 prolonging or maintaining the tightness of the shoe on the foot for a predetermined period of time after the shoe is unweighted. Footbed 68 which has a variable width from top to bottom is located within the shoe and indents the upper bladders forming an adjustable valve to vary and prolong the amount of force transmitted from the lower bladder 63 and upper bladders 66.

In use, the foot is placed inside of the shoe and the shoe is closed and tightened to a close comfortable fit in the conventional manner. During the weighting of foot strike, the elastomer sole 61 is compressed by the impact force. This movement compresses the sensing means lower bladder 63 forcing fluid into the tightening means upper bladder 66 through the passages 65 as flap valves 64 are forced open increasing the tightness of the fit of the shoe on the foot distributing the force to the foot. This tightness is maintained for a predetermined period of time due to the very slow recovery to the unweighted condition of the lower bladder 63 and lower sole 61 as a result of the slow flow of fluid through the recovery delaying valve mechanism passages 67 in closed flap valves 64 to the lower bladder 63 following unweighting of the sole. The amount of force and length of time that the force is transmitted from the lower sole 61 to the upper shell 62 and foot may be varied by varying the orientation of the footbed 68.

Details have been disclosed to illustrate the invention in the preferred embodiments of which adaptations and modifications within the spirit and scope of the invention will occur to those skilled in the Art. The scope of the invention is limited only by the following claims.

What is claimed is:

1. A shoe including an upper shell and a lower sole secured to the upper shell, the improvement comprising:

means for sensing when a user of the shoe applies increased weight to the sole upon touching a support surface of the shoe;

tightening means responsive to the sensing means for increasing the tightness of the fit of the shoe on a foot of the user as the user applies the increased weight to the sole; and additional means coupled to the tightening means for maintaining the tightening of the tightening means for period of time after the user of the shoe reduces said increased weight from the sole.

2. A shoe according to claim 1 including means for varying the amount of tightening of the tightening means.

3. A shoe according to claim 2 wherein the means for maintaining the tightening of the tightening means includes a variable size slow recovery elastomer pad.

4. A shoe according to claim 2 wherein the means for maintaining the tightening of the tightening means includes an adjustable spring friction member.

5. A shoe according to claim 2 wherein the means for maintaining the tightening of the tightening means includes an adjustable valve.

6. A shoe according to claim 1 wherein the sensing means includes a footbed movable relative to the shell.

7. A shoe according to claim 1 wherein the sensing means includes a bar movable relative to the shell.

8. A shoe according to claim 1 wherein the sensing means includes a fluid filled compressible bladder.

9. A shoe according to claim 1 wherein the tightening means includes a strap.

10. A shoe according to claim 1 wherein the tightening means includes a bar.

11. A shoe according to claim 1 wherein the tightening means includes a fluid filled bladder.

* * * * *